United States Patent [19]

Glindmeyer et al.

[11] 3,982,566

[45] Sept. 28, 1976

[54] METHOD AND APPARATUS OF MAKING A WOVEN ZIPPER

[75] Inventors: Friedrich Glindmeyer, Stolberg; Wilhelm Friedrich Hennenberg, Alsdorf; Karl Limpens, Stolberg, all of Germany

[73] Assignee: William Prym-Werke KG, Stolberg, Germany

[22] Filed: Jan. 8, 1975

[21] Appl. No.: 539,613

Related U.S. Application Data

[62] Division of Ser. No. 484,031, June 28, 1974.

[30] Foreign Application Priority Data

June 29, 1973 Germany ..... 2333152

[52] U.S. Cl. ..... 139/35

[51] Int. Cl.[2] ..... D03D 1/00

[58] Field of Search ..... 139/11, 35, 116, 384 B; 24/205.01 C, 205.13 C, 205.16 C

[56] References Cited

UNITED STATES PATENTS 3,545,497 12/1970 Burbank ..... 139/116

3,791,417 2/1974 Glindmeyer et al. ..... 139/35

*Primary Examiner*—Henry S. Jaudon

*Attorney, Agent, or Firm*—Michael J. Striker

[57] ABSTRACT

A method of making a woven zipper is disclosed, and an apparatus for carrying out the method.

A zipper tape is woven from warp threads and weft threads. A coil-forming filament is advanced longitudinally of the weft threads and additionally is made to perform a movement about the surface of an imaginary cone whose base extends transverse to the longitudinal advancement of the filament. Cover threads, extending lengthwise of the weft threads are stepwise moved to the vicinity of the imaginary surface and held until the filament has passed them; thereupon, they are moved through the surface to the interior of the cone and a binding thread is passed behind them in longitudinal direction of the weft threads.

6 Claims, 27 Drawing Figures

FIG. 7a
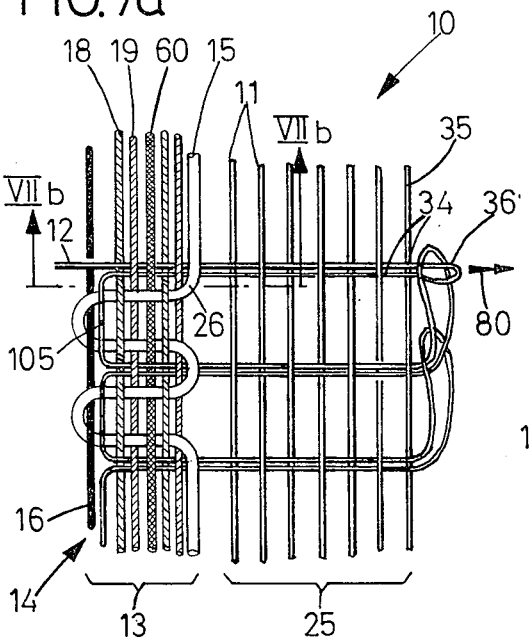
FIG. 7b
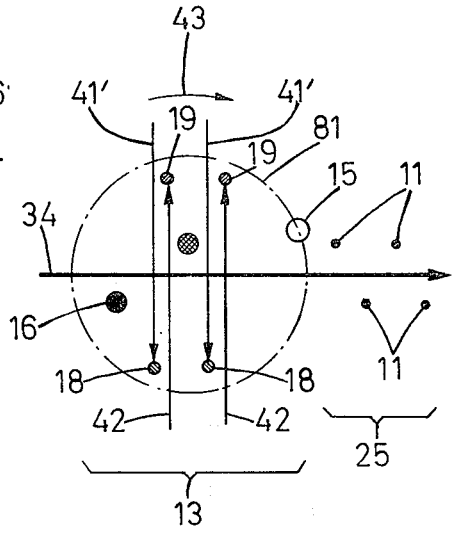
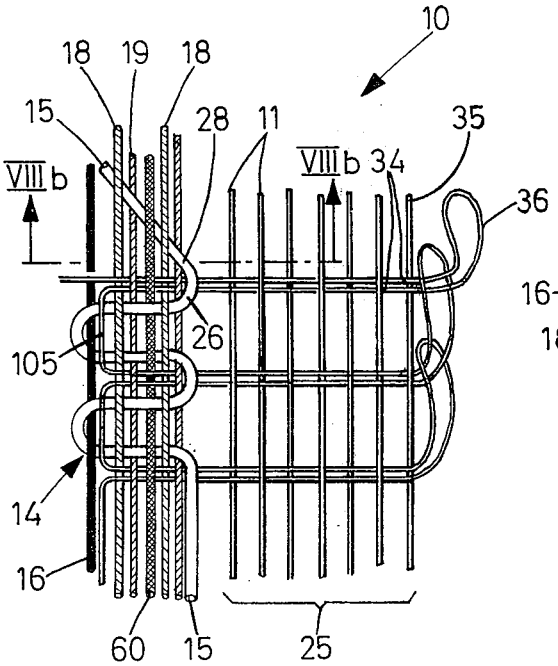
FIG. 8a
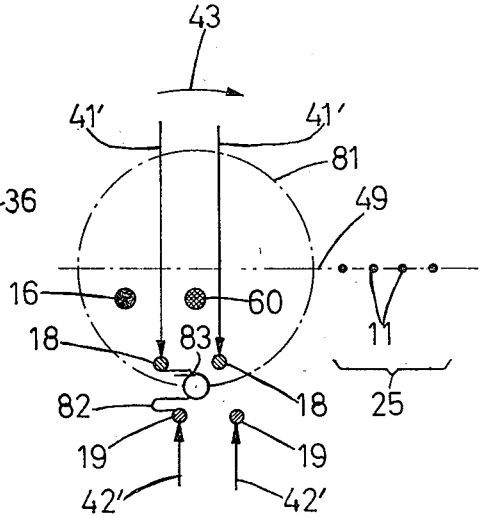
FIG. 8b

FIG. 9a
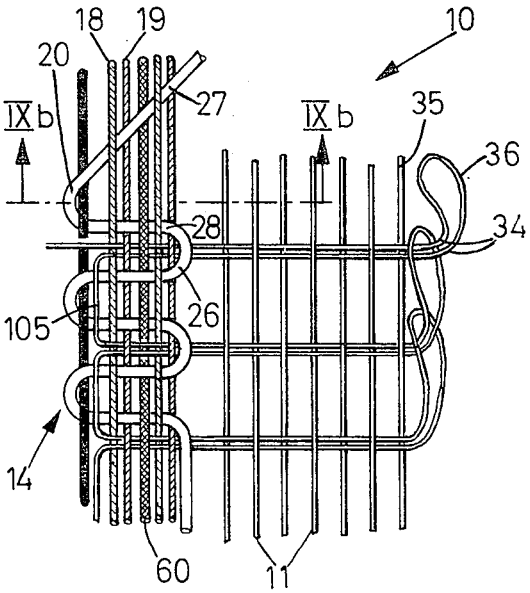
FIG. 9b
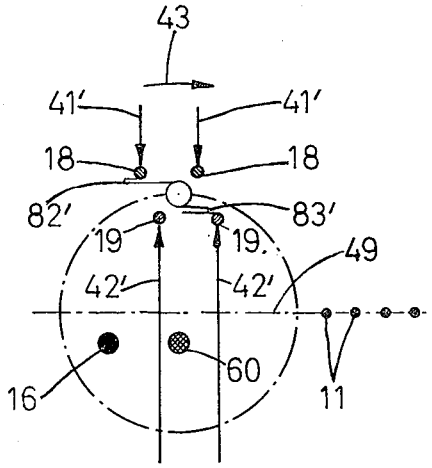
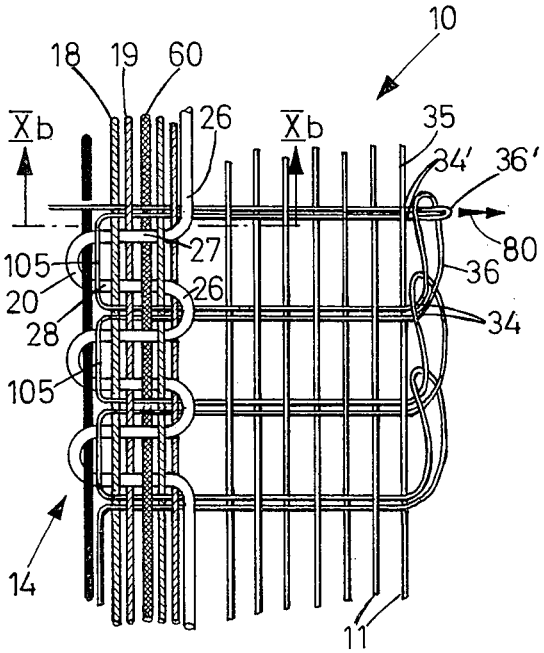
FIG. 10a
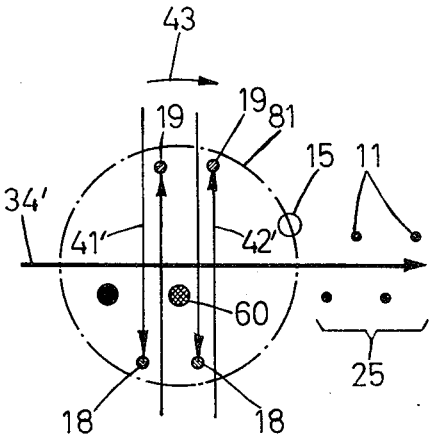
FIG. 10b

FIG.11a
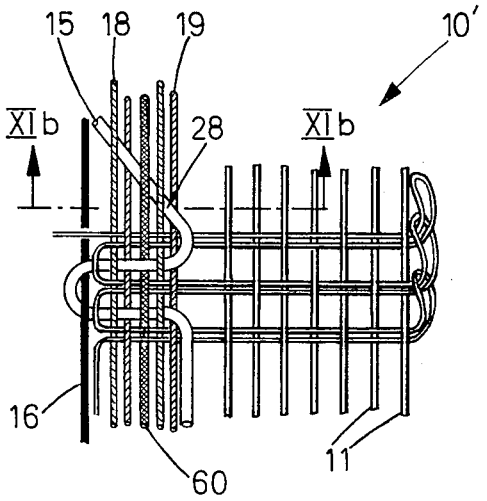
FIG.11b
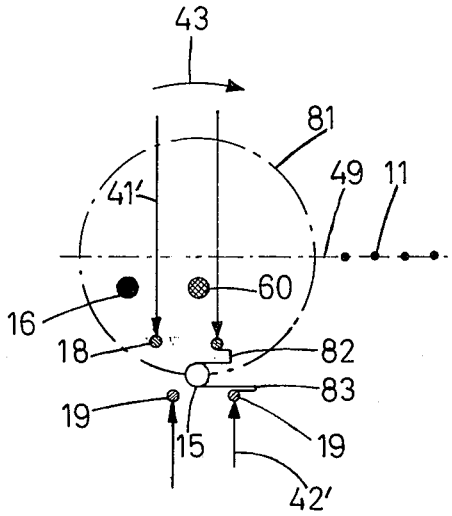
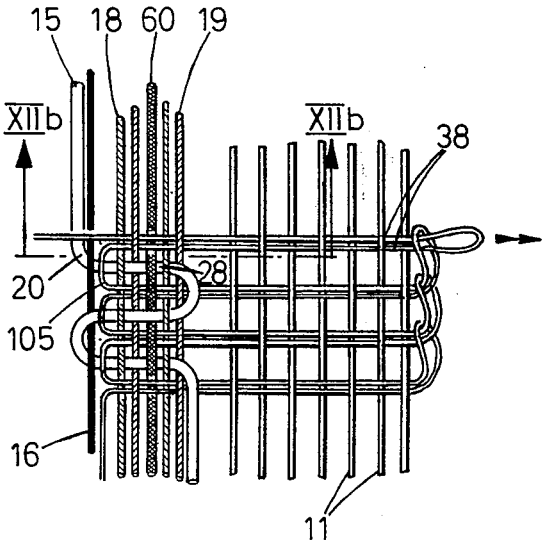
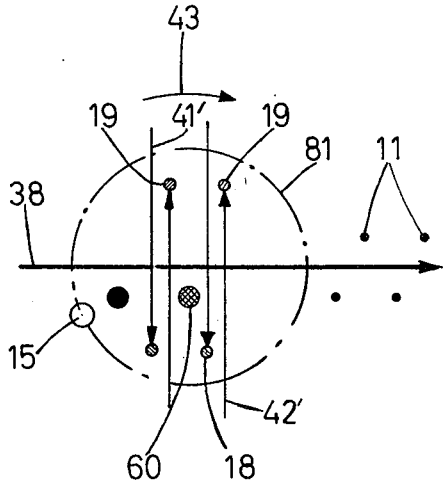
FIG.12a
FIG.12b

FIG.13a
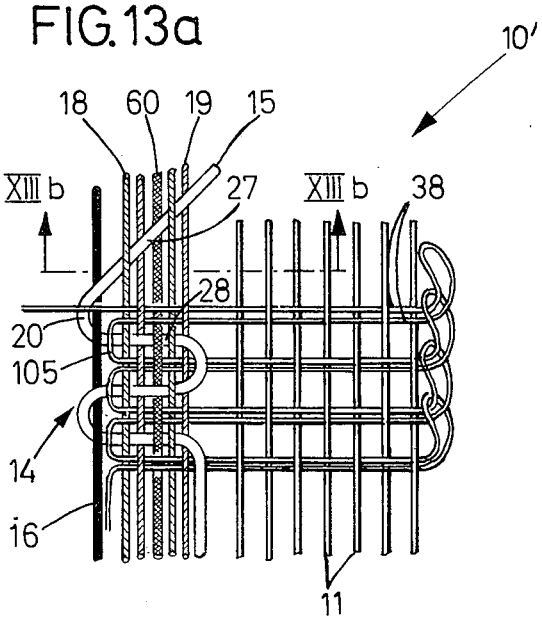
FIG.13b
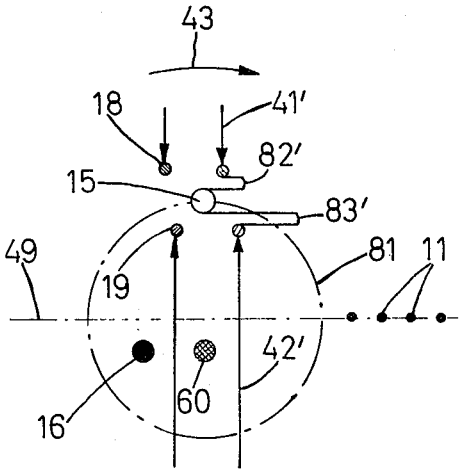
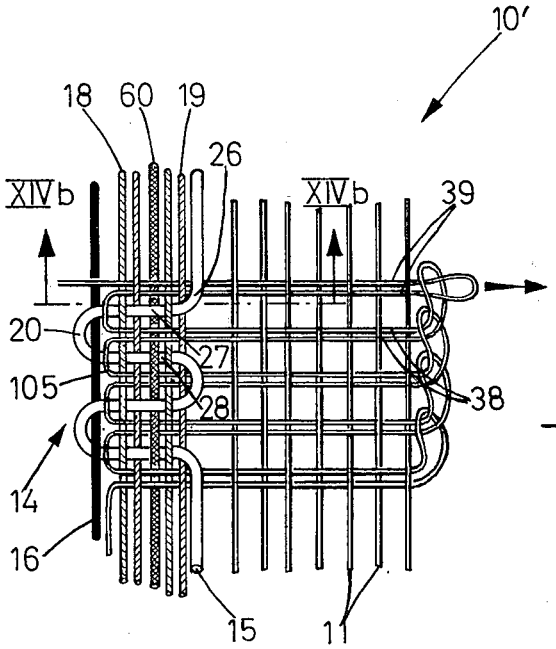
FIG.14a
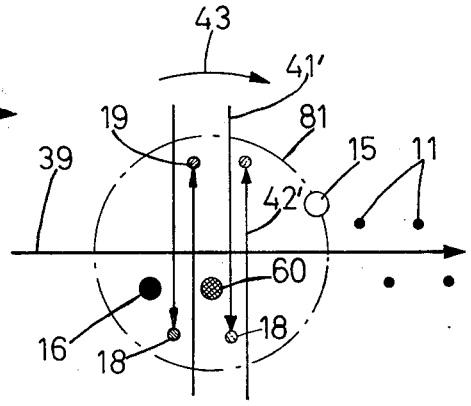
FIG.14b

FIG.19
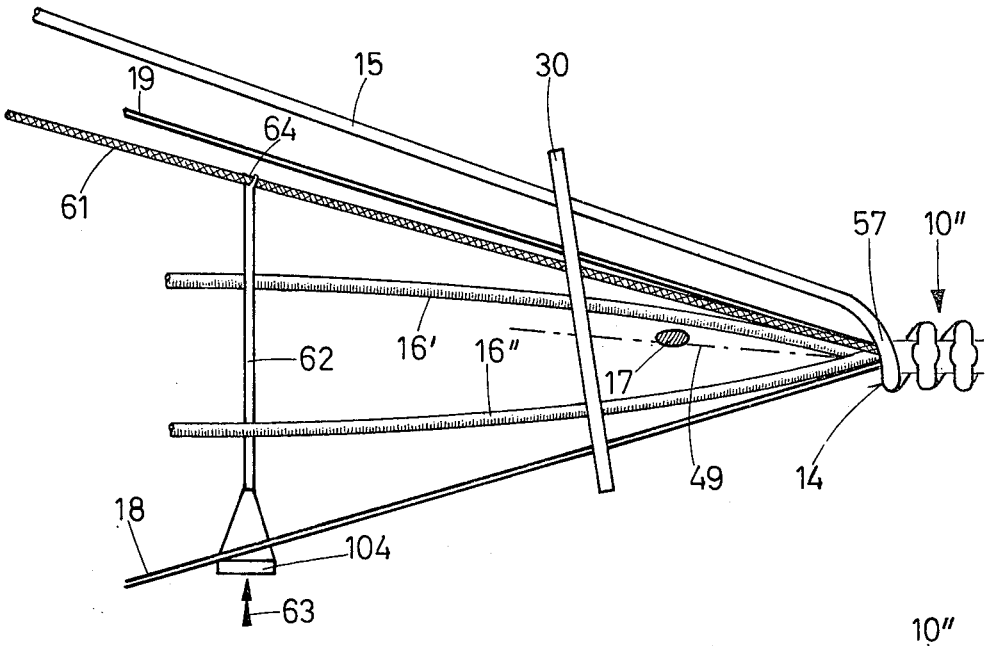
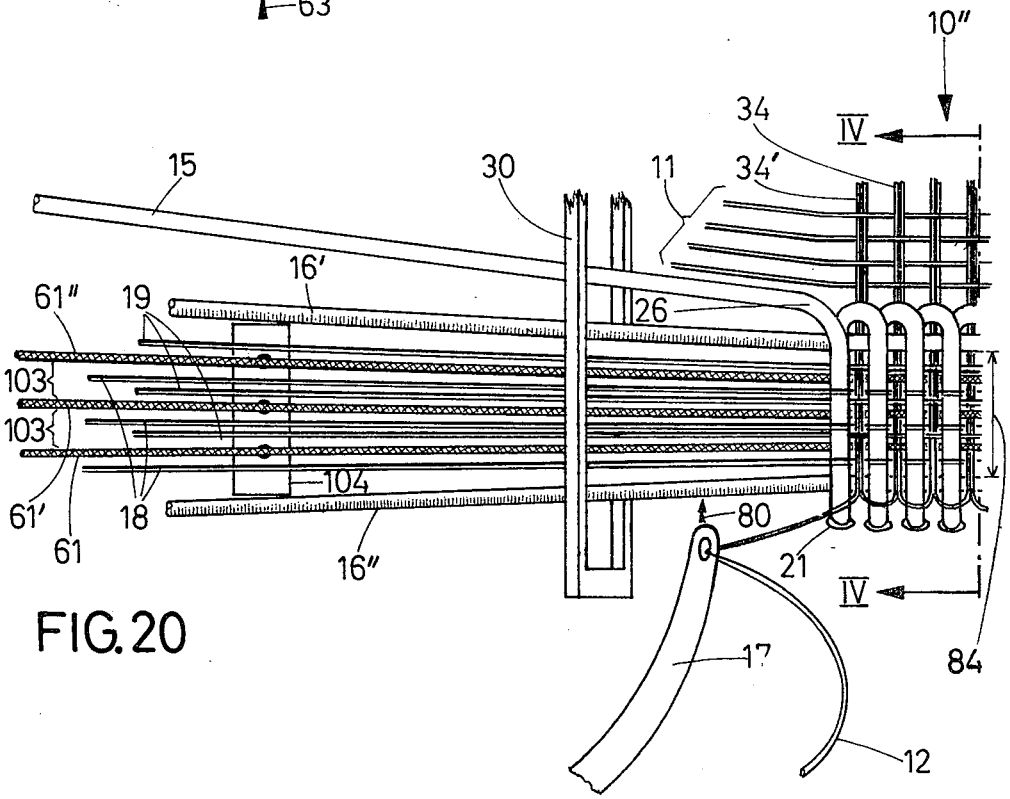
FIG.20

METHOD AND APPARATUS OF MAKING A WOVEN ZIPPER

This is a division of application Ser. No. 484,031, filed June 28, 1974.

BACKGROUND OF THE INVENTION

The present invention relates generally to a zipper, and more particularly to a woven zipper. Specifically, the invention relates to a method of making such a zipper, and to an apparatus for carrying out the method.

A woven zipper is disclosed in U.S. Pat. No. 3,692,068 wherein a zipper tape is formed, into a longitudinally extending marginal portion of which a filament forming the coupling portions of the zipper is inserted by means of a weft inserting needle into a separately provided weft shed of threads, and is then woven between these additional threads and the basic tape. As compared to other types of zippers, this has the advantage that the filament is secured to the tape with a plurality of threads, and that the manner in which these threads are inserted is relatively simple because they always extend above the legs of each loop into which the filament is formed, and because they always extend beneath individual weft threads. Moreover, such a zipper can be produced continuously and can utilize a filament of any desired length, so that no interruptions in the manufacture result from running out of the thread supply or the filament supply.

German Pat. Nos. 2,023,055 and 2,125,470 disclose how a woven zipper can be made by, in effect, weaving a coil-forming filament onto the zipper tape as the latter is being produced. The filament is connected to the tape by the weft threads which engage those loop portions of the coil convolutions that overlie the tape. While this approach to zipper making has many advantages, it does have the drawback that the filament coil is not very sturdily secured to the tape. Also, the position of the individual coil loops are not as finely fixed as is desirable and, because of the engagement of the aforementioned loop portions by the weft threads, these loop portions are not available to guide the zipper slider, as would be desirable in the interest of easier operation of the latter.

SUMMARY OF THE INVENTION

Accordingly, it is an object of the invention to further improve the manufacture of woven zippers of the type under discussion.

More specifically, the invention seeks to provide an improved method of making such a zipper, which assures that the filament coil is more securely fastened to the zipper tape.

Another object of the invention is to provide such a method which assures easier operation of the slider.

Still a further object is to provide an apparatus for carrying out the method.

In keeping with the above objects, and with others which will become apparent hereafter, one feature of the invention resides in a method of making a woven zipper. Briefly stated, this method comprises the steps of weaving a zipper tape from warp threads and weft threads; during weaving of the zipper tape alternately opening and closing a shed composed of cover threads which extends longitudinally of the warp thread; advancing in longitudinal direction of the weft threads a coil-forming filament which in the region of the shed additionally performs a movement about the marginal surface of an imaginary cone whose base extends transverse to the direction of advancement of the filament; moving said cover threads to the exterior vicinity of the imaginary surface and holding them in position until the filament has moved past them along the imaginary surface; shifting said cover threads through said imaginary surface inwardly thereof after said filament has moved past them; and inserting a binding thread transverse to and in a plane behind the cover threads.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIGS. 7*a*–10*a* are diagrammatic fragmentary plan views illustrating the zipper in FIGS. 1 and 5 during weaving, and in four different working positions of the various threads and the filament;

FIGS. 7*b*–10*b* are diagrammatic views illustrating the positions of the several threads and the filament of FIGS. 7*a*–10*a*, respectively, on lines VII*b*—VII*b* to X*b*—X*b* of FIGS. 7*a*–10*a*, respectively;

FIGS. 11*a*–14*a* are views resembling FIGS. 7*a*–10*a*, but illustrating a further embodiment of the invention, namely that which is shown in FIG. 6;

FIGS. 11*b*–14*b* illustrate subject matter analogous to FIGS. 7*b*–10*b*, but with respect to FIGS. 11*a*–14*a* and on lines XI*b*—XI*b* to 14*b*—14*b* of FIGS. 11*a*–14*a*, respectively;

FIGS. 19–20 are a side view and a top view of threads at the weaving station of a further embodiment of an invention which weaves the zipper shown in FIG. 4.

DESCRIPTION OF THE PREFERRED EMBODIMENTS

Figure 1:
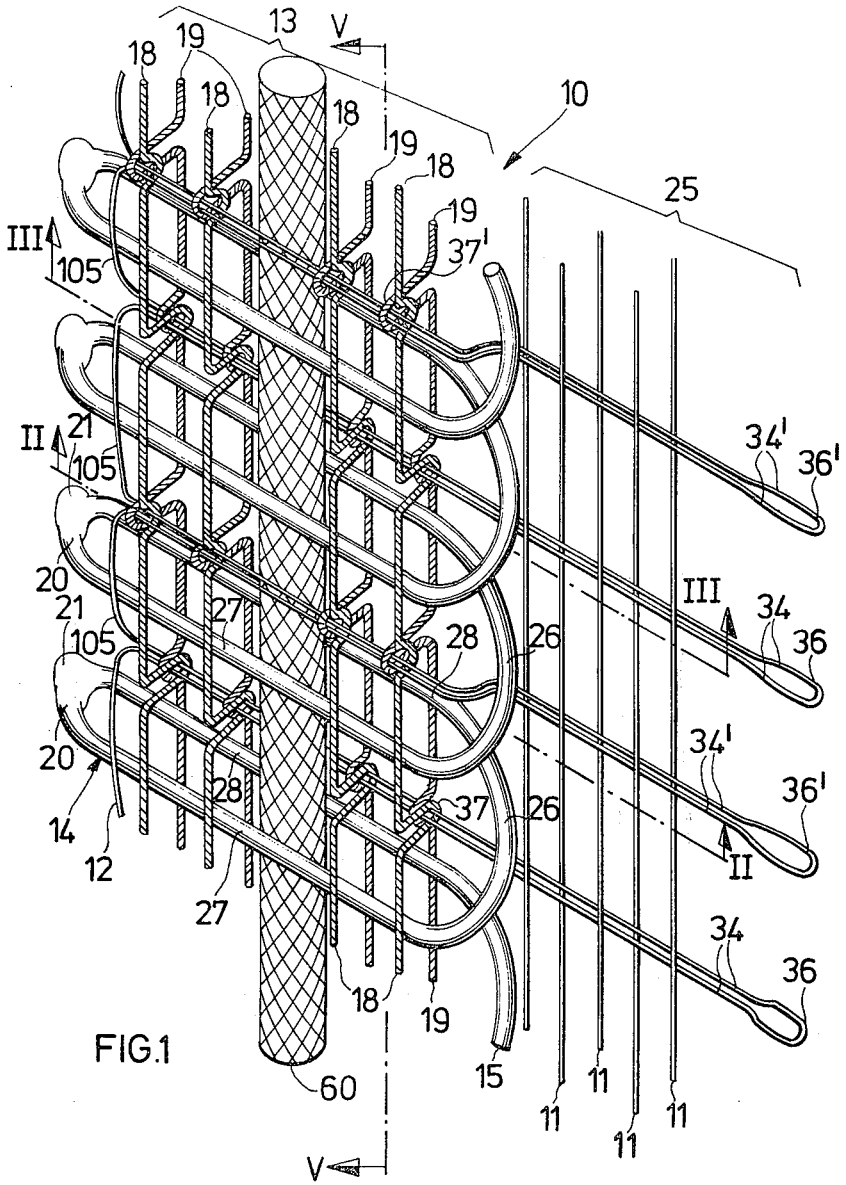
FIG. 1 is an enlarged-scale somewhat diagrammatic perspective view, illustrating one section of a zipper produced in accordance with the invention.

Referring firstly to FIGS. 1, 2, 3 and 5, it will be seen that the woven zipper illustrated therein—which is produced by the method and apparatus of the invention—is generally identified with reference numeral 10.

Figure 16:
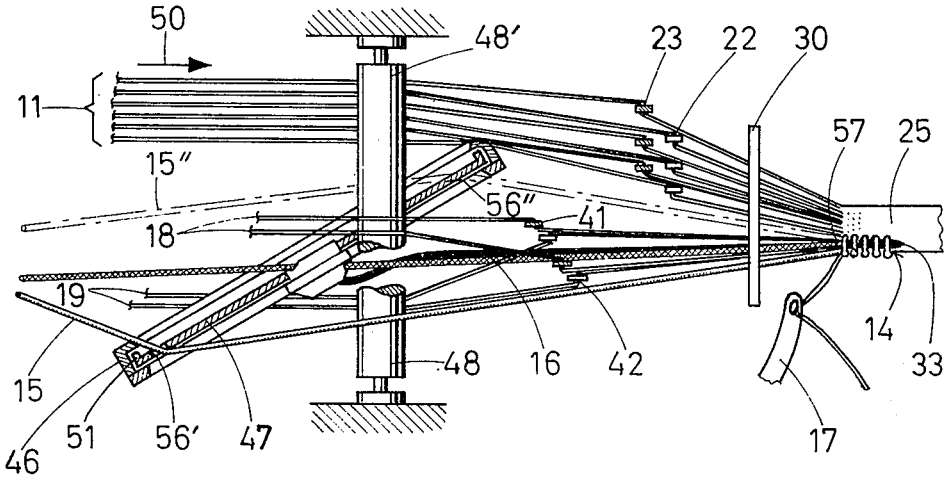
FIG. 16 is a partially sectioned view taken on the two section lines XVI*a*—XVI*a* and XVI*b*—XVI*b* of FIG. 15.

Actually, only a detail of one section of a zipper is illustrated, it being understood that a zipper, of course, has two complementary sections. The illustrated section has a diagrammatically shown zipper tape 25 which serves to connect the zipper to a garment or the like in conventional manner. It also has a marginal portion 13 on which a filament 15 forms a plurality of loops 14, in that it is woven to the tape so as to lie thereon in an undulate path. Weft thread portions 34 and 34' are woven into the zipper tape 25 extending transversely thereof, and are formed of a weft thread 12 which also extends into the marginal portion 13. These cooperate with warp threads 11 extending longitudinally of the zipper tape 25. As FIG. 16 shows particularly clearly, the weft thread 12 is inserted by a needle 17 in lateral direction, so that each of the portions 34, 34' is formed of a loop-shaped double thread which, as the views of the individual weaving steps shown in FIGS. 7*a*–10*a* show, is formed along the edge 35 with loops 36, 36' which are held in place, for instance by interengagement as shown in FIGS. 7*a*–10*a*.

It should be understood that it would be possible to insert the weft thread 12 with a shuttle, rather than a needle.

The filament 15, which advantageously is of deformable synthetic plastic filamentary material, is laid down in an undulate path and forms the loops 14. Where each loop is laid down the filament 15 forms a curved connecting portion 20 which is provided with a coupling projection 21 that is intended to cooperate with a corresponding projection of the other zipper section. These coupling projections 21 are formed in advance in the filament at the requisite locations. At the opposite side of the loops 14 the latter are formed with curved connecting portions 26 which are free of any other threads, that is not engaged by any other threads. The connecting portions 20 and 26 are connected with one another by legs 27, 28 which are located in pairs essentially vertically spaced and extend parallel to the plane 32 of the tape 25, which plane is indicated in broken lines in FIGS. 2 and 3. The series of loops 14 could also be produced by configurating the filament 15 as a meander, but aside from this the zipper would be the same as in FIGS. 1, 2, 3 and 5.

In longitudinal direction of the row of loops 14 there extends intermediate the pairs of legs 27, 28 an elongated flexible supporting element 60, and the weft thread portions 34, 34' alternately extend in front of and behind the element 60. The margin 13 is further provided with cover threads 18 and 19, of which the threads 18 form one group that is located exclusively in front of the legs 27, and the threads 19 form another group that is located exclusively behind the threads 28. In the spaces between adjacent pairs of legs 27, 28 the threads 18, 19 are looped together with the weft thread portions 34, 34', in that the lower group of threads 19 always travels over one of the portions 34, 34', whereas the upper group of threads 18 always travels under the same. This means that the two groups of threads 18, 19 cooperate in mirror-symmetrical manner. Since the threads 18 and 19 are always located above or below, that is, in front of or behind the portions 34, 34', a looping together is obtained only in cooperation with the legs 27, 28, and this—in conjunction with the cooperation of the element 60—obtains an excellent interengagement which assures that the spacing of the legs 27, 28 is fixed and remains fixed, as evident from FIG. 5. The threads 18 and 19 surround, when they travel through the spaces between the pairs 27, 28 of legs to the weft thread portions 34, 34', each individual convolution of the loops 14, thus preventing both axial displacement and in fact any other type of displacement that might occur otherwise. The element 60 fills the space between cooperating pairs of legs 27, 28, and thus also precisely predetermines the height of the series of loops 14. It should be pointed out that for reasons of better illustration the element 60 has not been shown to scale in FIG. 5, but has actually been shown much thinner to facilitate the explanation.

Figure 2:
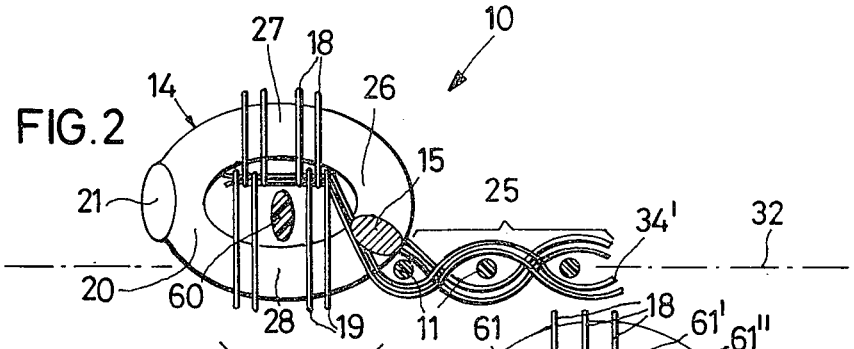
FIGS. 2 and 3 are diagrammatic cross sections taken on lines II—II and III—III of FIG. 1, respectively.
Figure 3:
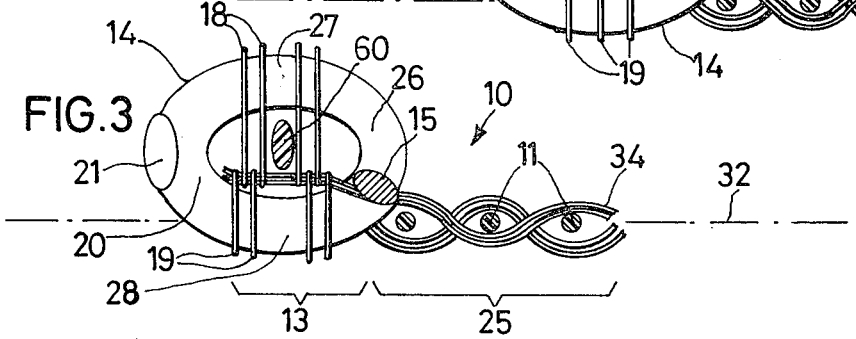

As FIGS. 1, 2 and 3 show particularly clearly, the connecting portions 26 are free of engagement by any other threads. The series of loops 14 is located at one side of the plane 32 of the tape 25, so that an excellent guide surface is obtained for a zipper slider (not shown). The weft thread portions 34, 34' are mirror-symmetrically engaged by the two groups of threads 18, 19, and the points of engagement 37, 13' are alternately located in front of and behind the element 60. Each full loop of this zipper, which loop is composed of a pair of legs 27, 28 requires only a single weft thread portion 34, 34'.

Figure 6:
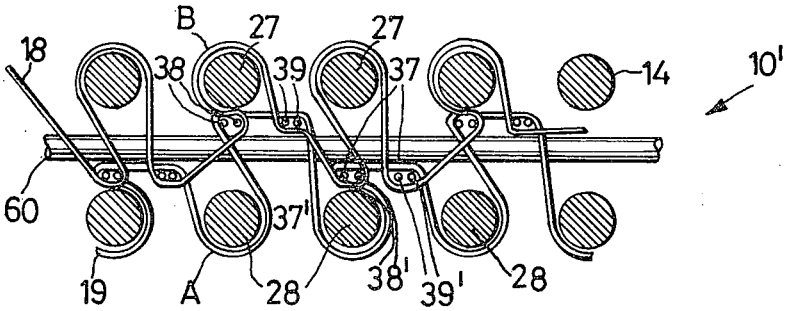
FIG. 6 is a view similar to FIG. 5, but illustrating a somewhat different embodiment of the invention.

By way of example, FIG. 6 shows that different embodiments are also possible. The zipper 10' in FIG. 6 differs primarily from that of the preceding embodiment of FIG. 1 in that over the height of one loop there are provided two weft thread portions 38, 38 or 38', 38', so that the zipper tape has a souble weft thread thickness. Here, the points of engagement 37, 37' of the threads 18, 19 are alternately located twice above the element 60 at 37', and twice behind the element 60 at 37. FIG. 6 shows that this provides for a particularly good and stable construction, because there are always two of these points of engagement located between two adjacent legs 27, 28; i.e., an upper point 37' and a lower point 37 for the legs 27, and alternately two upper points 37', 37' and two lower points 37, 37' for the legs 28.

Other possibilities exist also, so that for instance in the case of the embodiment of FIG. 1, only a group of threads 18 might be utilized, in which case the points of engagement might be located exclusively behind the element 60 as indicated at 37, because all weft thread portions 34 would extend only behind the element 60. It would also be possible not to have all of the threads 18, 19 engage each of the weft thread portions 34, 34', but instead to have only some of the threads 18 or 19 of a particular group engage, in the space between two adjacent legs 27, 27 or 28, 28, an intermediately located weft thread portion 34 or 34'. Although the element 60 determines, due to its cross section, the positioning of the weft thread portions 34, 34' in the region of the loops 14, it would be possible in the case of two groups of mirro-symmetrically arranged threads 18, 19 to omit the element 60, because the alternation of these threads relation to one another will still result in a proper retention of the weft thread portions 34, 34' in cooperation with the threads 18, 19.

Figure 15:
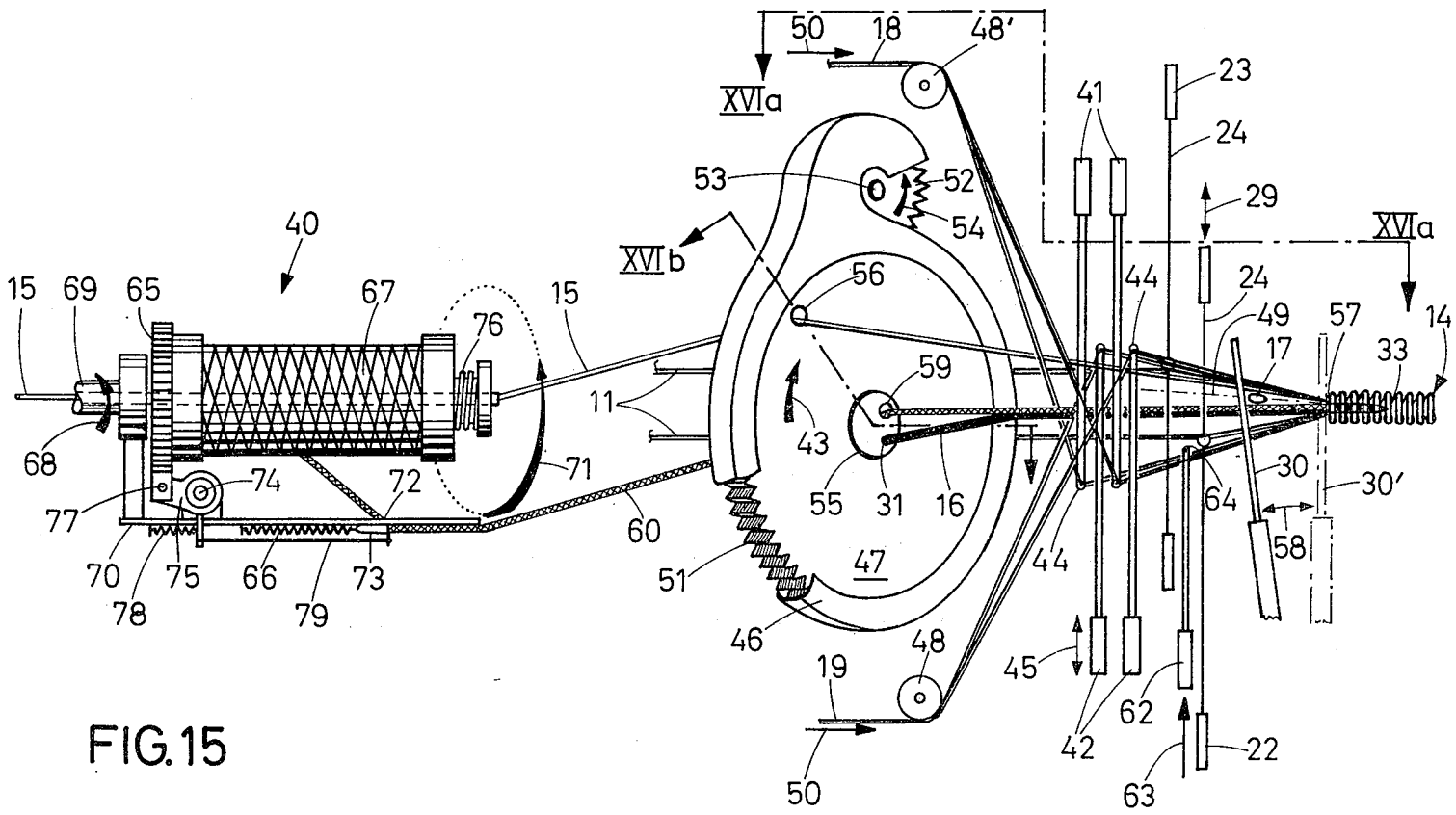
FIG. 15 is a diagrammatic side view of an apparatus for making the zipper of FIG. 1, with only those portions illustrated that are necessary for an understanding of the invention.

The zipper 10 of FIG. 1 can be produced in an apparatus which is shown in FIGS. 15 and 16 insofar as its components are necessary for an understanding of the invention. Components which are not considered to be necessary for an understanding of the invention, and which are conventional, have been omitted.

FIG. 15 shows in a lateral view, and FIG. 16 in a top view that the threads 11, the filament 15 and the groups of threads 18, 19 must form an appropriate shed which is visible in side view in FIG. 15, to permit the travel of the inserting needle 17. The members 22, 23 serve as the thread guiding arrangement for the threads 11; their number depends upon the type of weave that is desired, and at the middle they are formed with harnesses 24 provided with eyelets. The control arrangement which effects the movement of the members 22, 23 in the direction of the arrow 29 is known in the art and requires, therefore, no discussion.

Located behind the members 22, 23 are the thread inserting devices for the threads 18, 19, which devices are in form of harnesses 41, 42 of requisite number, the front ends of which are formed with eyelets 44 for a respective one of the threads 18 and 19 and which are also controlled for movement in the direction of the arrow 45 by a known control device. During this movement, they pass through the working plane 49 of the needle 17, which plane is shown in broken lines in FIG. 15. FIG. 15 shows such a passing through the plane, because the harnesses 42 intended for the lower threads 19, which are usually located in the lower part of the shed beneath the plane 49, have just been lifted up into the upper part of the shed in FIG. 15, whereas conversely the harnesses 41 for the threads 18 which are supplied from above, have just been made to travel through the plane 49 into the lower part of the shed. The threads 18 and 19 are withdrawn from non-illustrated supply stools and are guided in the direction of the arrow 50 over the vertically spaced guide rollers 48, 48.

A turnable rotor 47 is mounted behind the harnesses 41, 42 and has essentially the form of a flat disc-shaped wheel. FIG. 16 shows that the rotor 47 extends diagonally to the direction 50 so that at the side facing towards the needle 17 there is sufficient room ahead of the rotor 47 for locating the harnesses 41, 42. The rotor 47 is mounted in an annular housing 46 which is formed with an inner groove for the rotor 47, as best shown in FIG. 16, where the rotor is illustrated along the line VXI*b*—XVI*b* of FIG. 16, but in a position which is turned with reference to the position shown in FIG. 15.

As FIG. 16 shows, the rotor 47 has an opening 56 in its marginal portion, through which the filament 15 passes. The opening 56 is illustrated in an approximately horizontal location 56′ in FIG. 16. The periphery of the rotor 47 is formed with teeth 51 which mesh with a gear 52 that is driven by a shaft 53 and turns in the direction of the arrow 54, thus imparting to the rotor 47 a rotation in the direction of the arrow 53. No attempt has been made to illustrate the bearing and the drive for the shaft 53, or the mounting for the housing 46, because these are conventional features and would unnecessarily encumber FIGS. 15 and 16. The diameter and the height of the rotor 47 are so selected that from the upper portion of the open shed the filament 15 will travel, during further rotation of the rotor 47, into the lower portion of the shed.

The rotor 47 has a central insert 55 which is stationary when the rotor turns. This insert 55 has connected to it one end 31 of a loop-forming member 16 which is stationarily located, always on one side with reference to the above mentioned working plane 49, that is in the illustrated embodiment below the working plane 49. The other free end 33 of the member 16 extends somewhat into the interior of the row of loops 14 being formed, as FIGS. 15 and 16 illustrate.

In addition, the insert 55 is provided with an opening 56 through which the element 60 extends which is withdrawn from a supply spool 67 that is located behind the rotor 47. The rotor 47 is mounted on a hollow shaft 69 which is provided with an axial bore and is a part of the turning device 40 which will be described in more detail. The filament 15 extends through the axial bore of the hollow shaft 69 and through the opening 56 of the rotor 47. The supply spool for the filament 15 is not visible, being located to the left of the device 40 and thus outside the scope of the drawing. The threads which are supplied in the direction 50, namely the threads 11, the threads 18, the threads 19, the filament 15 and the element 60, are beaten up by a reed 30 after each insertion of the weft threads 12 and subsequent closing of the shed, against the beating-up point 57, whereas the reed travels in the direction of the arrow 58 from its full-line position to its broken-line position 30′ in FIG. 15. During the weaving, that portion of the filament 15 which is located between the beating-up point 57 and the rotor 47 perform a movement along an imaginary conical surface about the member 16, as well as about the element 60, the base of this imaginary conical surface being determined by the rotational direction 43 of the opening 56 in the rotor 47. The tip of the imaginary conical surface is located at the beating-up point 57.

The working field for the movement up and down of the harnesses 41, 42 in the direction 45 is determined by this imaginary conical surface, as is more clearly evident from FIG. 16. This working field must be located within a triangular area which is determined by the intersection of the aforementioned conical surface with the above mentioned working plane 49. Two corner points of this triangular area are visible in FIG. 16, and this area determines the working field for the longitudinal movement of the harnesses 41, 42, it being understood that the section for the rotor 47 which is shown in FIG. 16 is located approximately in the working plane 49 of the needle 17. One of the corner points of the triangular area is determined by the one lateral position 56′ of the eye for the filament 15, whereas the other corner point of the triangular area is determined by the diametrically opposite position 15″ of the filament 15, when this eye is located in the position designated with reference numeral 56″ in FIG. 16. The triangular area is, therefore, determined by the points 56′, 56″ and 57 and the harnesses 41, 42—of which more than the illustrated four may be present—operate within this area. Assuming that a zipper is produced of the type that is to be used in a garment, then as a rule it will be customary to use eight of the harnesses 41, 42, since eight of the threads 18, 19 would be employed. If the element 60 is centrally located with respect to the opposite lateral sides of the row 14 of loops, then it is advantageous if the harnesses 41, 42 are uniformly divided and located at opposite sides of the element 60, as shown in FIG. 16.

During the rotation of the rotor 47, the filament 15 forms the loops 14 in the region of the beating-up point 47 about the member 16 and the element 60. However, at the reverse side of the rotor 47 the filament 15 also travels along a substantially conical surface which is, however, mirror-symmetrical with reference to the previously mentioned one. This could inherently lead to undesired convoluting of the filament 14 about the element 60. This, however, is eliminated by the device 40. The latter has a bracket 70 provided on the hollow shaft 69 and formed with a hole 72 (see FIG. 15) which determines the point at which the element 60 is withdrawn from the spool 67. In place of or in addition to a brake for the spool, of which brake the spring 76 is shown by way of example, a blocking wheel 65 is provided with teeth coupled with the spool 67, and is unblocked at the appropriate point in time by means still to be described, so that a further increment of the element 60 becomes available at the location 57, as required. The drawing shows that the element 60 travels through an additional eyelet 73, which is biased by a tension spring 66 one end of which is mounted on the bracket 70. Under the influence of the spring 66 of the eyelet 73 can longitudinally shift and serves to store a short increment of the element 60 at the bracket 70. A pin 74 is also provided on the bracket 70 and is formed with an angular arm 75 one end of which is provided with a pawl 77 that normally engages the teeth of the wheel 65. The other end of the arm is engaged by a restoring 78. Connected with this arm there is also a lever system 79 against which the eyelet 73 abuts, after the spring 66 has been tensioned to the maximum as a result of the using up of the stored increment of the element 60. When this takes place, the lever system 79 pivots the arm 75 counter to the action of the spring 78 and withdraws the pawl 77 from engagement with the reel 65, so that the spool 67 can freely turn and permits another increment of the element 60 to be withdrawn. As this takes place, the spring 66 restores the eyelet 73 to its original position, so that the pawl 77 is again moved into blocking engagement with the reel 65 by the spring 78.

The undesired twisting together of the filament 15 and the element 60, which is to be avoided as outlined above, is in fact avoided in that the bracket 70 together with the shaft 69 turns in the direction of the arrow 68, and this turning in the direction of the arrow 68 is synchronous with the rotation of the rotor 47 in the direction of the arrow 43. This results in a movement 71 of the element 60 behind the rotor 47, and this prevents the undesired twisting together or looping together of element 60 and filament 15.

Figure 5:
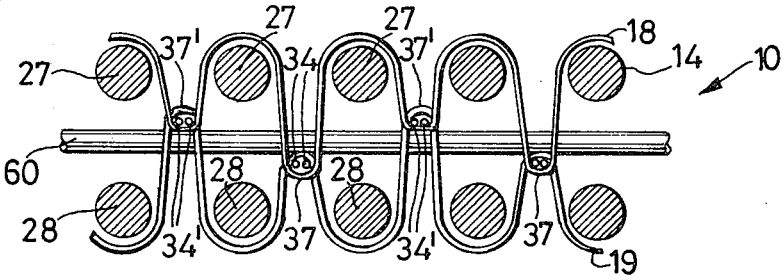
FIG. 5 is a fragmentary section taken on line V—V of FIG. 1.

Due to the positioning of the opening 59 in the rotor insert 55 the element 66 is normally located in the lower part of the shed, that is below the working plane 59 of the needle 17. FIG. 15 shows that this is where the member 16 is also always located. Accordingly, FIG. 5 shows that the weft thread portions 34' of the weft thread 12 will be located above the element 60. To assure that at the desired locations of the zipper the element 60 will be located above the weft thread portions 34, a pusher 62 is provided which at the appropriate time is lifted by a non-illustrated but conventional control device in the direction of the arrow 63 in FIG. 15, because a notch 64 provided in its end then engages the element 60 and raises it into the upper part of the shed.

FIGS. 7*a*–10*a* and 7*b*–10*b* show four working positions by means of which the weaving required to produce the zipper 10 of the embodiment in FIGS. 1, 2, 3 and 5 will be discussed in more detail.

In the first working position, shown in FIGS. 7*a* and 7*b*, a weft thread portion 34 of the weft thread 12 is just being inserted in the direction of the arrow 80. The threads 11 are spaced from one another, as shown in FIG. 7*b*, in the area of the zipper tape 25. A further shed formed by such spacing also exists in the marginal portion 13. FIG. 7*b* shows that the member 16 is always located in the lower portion of the shed, which is true for the other working positions also. The broken line circle 81 is intended to illustrate the movement of the cross section of the filament 15, which is shown in FIG. 7*b*, when this first filament moves along the aforementioned imaginary conical surface. In the position of FIG. 7*b*, the element 15 is located in the upper portion of the shed above weft thread portion 34. If one were to characterize the different positions to which the filament 15 moves, by relationship to the dial of a clock, then it could be said that in FIG. 7*b* the filament 15 is located at the "2 o'clock" position. The cross section of element 60 that is shown in these Figures indicates that the pusher 62 has raised the element 60 into the upper part of the shed, so that it is located above the weft thread portion 34. The arrows 41', 42' indicate the positions reached by the threads 18, 19 due to the longitudinal movements of the harnesses 41, 42. It is clear that the upper group of threads 18 has moved beneath the weft thread portion 34 into the lower part of the shed, whereas the lower group of threads 19, which is mirror-symmetrical with reference to the upper group 18, has been moved through the plane 49 into the upper part of the shed so that they are located above the weft thread portion 34. This position of the threads 18, 19 is also evident from FIG. 7*a*, and during this phase of the operation a curved connecting portion 26, which is free of engagement with other threads, is just being produced in the row 14 of loops.

A further operation position or phase is shown in FIGS. 8*a* and 8*b*. In this position, the filament 18 has traveled through more than 90° along the imaginary conical surface, which is represented diagrammatically by the broken-line circle 81, the direction of movement having taken place in the direction of the arrow 43, so that the filament is now in the "6 o'clock" position. The weft thread portion 34 has just been completely inserted by the needle 17, and the needle 17 has been fully withdrawn from the shed. The end loop 36 of the weft thread portion 34 is retained and passes through a previous loop portion 36'. The member 16 continues to remain in its previous position below the working plane 49. The shed of the threads 11 may have closed again, and the pusher 62 has retracted so that the element 60 is back in its usual position below the working plane 49, in which position it remains during the following operating phases which are shown in FIGS. 9*a*, 9*b* and 10*a*, 10*b*.

The arrows 41' indicate that the treads 18 are still located within the circle 81 which designates diagrammatically the imaginary conical surface on which the filament 15 moves, when the phase shown in FIGS. 8*a*, 8*b* is reached. In fact, the threads 18 have a position which, in effect, is unchanged with respect to their position shown in FIG. 7*b*. However, FIG. 8*b* shows that in this third phase the threads 18, indicated by the arrows 42', has moved outside of the circle 81 and are now spaced from the filament 15 by a distance 82, whereas the threads 18 are spaced inwardly of the circle 81 by a distance 83 from the filament 15. Thus, when the filament 15 is located at the side of the conical surface represented by the circle 81 which faces towards the threads 19, the two groups of threads 18, 19 are moved apart and form a shed, thus producing a passage composed of the distances 82, 83 through which the filament 15 can travel. In this phase of operation, the filament 15 forms the leg 28 for the next-following loop of the row 14, as shown in FIG. 8*a*.

In the operating position of FIGS. 9*a*, 9*b*, the filament 15 has traveled through 180° from its starting position in FIGS. 7*a*, 7*b*, so that it has reached the "12 o'clock" position. The element 16 and the threads 11 have not changed their positions, and the member 16 continues to be located below the working plane 49. The arrows 41', 42' indicate that the position of the threads 18, 19 is now reversed, however, so that it is now the threads 18 which are located outside the circle 81 at a spacing 82', whereas the group of threads 19 is located at the other side, preferably already inside the circle 81, to be in the position which is desired for the next-following operating position or phase which will be described with reference to FIGS. 10*a*, 10*b*. This means that in FIGS. 9*a*, 9*b* another passage 82', 83' is obtained through which the filament 15 can travel freely. At this time the curved connecting portion 20 formed with one of the coupling projections 21 has been formed, and FIG. 9*b* also shows that at this time the upper leg 27 is produced, as a comparison with FIG. 9*a* will illustrate.

In the final illustrated working position of FIGS. 10*a* and 10*b*, the filament 15 has traveled approximately 60° further in the direction of the arrow 43, thus having moved to the "2 o'clock" position. The filament 15 is now located in the upper portion of the newly-opened shed which has been opened for insertion of the next weft thread portion 34'. The element 60 is located in the lower portion of the shed, together with the member 16, that is beneath the working plane and within the area surrounded by the circle 81. Located within this area are now also the threads 18, 19. While as indicated by the arrows 42', the lower threads 19 are in the position which was already evident from the previous phase in FIGS. 19 and 9*b*, the threads 18 of the upper group have been moved through the working plane downwardly beneath the weft thread portion 34'. A further curved connecting portion 26 for the next loop of the row 14 is being produced. As FIG. 10*a* shows, the connecting loops 36*a* is again pulled through the preceding connecting loop 36. In fact, the position of FIGS. 10*a* and 10*b* corresponds to the position of FIGS. 7*a* and 7*b*, with the difference that here the element 60 is in a lowered position located beneath the working plane. It is very evident that during the insertion of the weft thread portions 34 the element 60 cooperates with the threads 19, whereas during the next-following insertion of the weft thread portion 34' the element cooperates with the threads 18, as has already been described with respect to FIG. 5.

A comparison of FIGS. 8*b* and 9*b* on the one hand, and FIGS. 7*b* and 10*b* on the other hand, indicates that the two passes 82, 83 on the one hand, and 82', 83' on the other hand are oriented parallel to the shed opening of the threads 11, but vertically offset with reference to it and to one another. While the insertion of the weft thread portions 34, 34' takes place approximately in the region of the longitudinal center of the imaginary conical surface described earlier, the aforementioned passages developed at the uppermost and lowermost position of the conical movement, respectively. It is also evident from what has been described above that the opening of the shed and the development of the passages 82–83 and 82'–83', respectively, follow one another in time.

Coming now to FIGS. 11*a*–14*b*, it will be seen that these illustrate the same operating steps that have been shown with respect to FIGS. 79–10*b*, but for the weaving of the zipper 10' that is shown in FIG. 6. The same reference numerals are used as in the preceding embodiment, and the operation is the same as already described, except for the following differences.

In the first operation position or phase shown in FIGS. 11*a* and 11*b*, the filament 15 is in the "6 o'clock" position, and the threads 18, 19 define with one another the passage 82, 83. The member 16 is always located beneath the working plane 49 in which the weft thread 12 is inserted, and the element 60 remains beneath this working plane during the following four working positions that will now be described. In the working position or phase of FIGS. 11*a* and 11*b*, the lower loop leg 28 is being produced, as indicated also at A in FIG. 6.

FIGS. 12*a* and 12*b* indicate that, while the filament 15 has traveled through less than 90° on the circle 61 which is indicative of the imaginary conical surface along which the filament 15 travels in the direction of the arrow 43, and now a first weft thread portion 38 is inserted while the filament 15 is still in the lower part of the shed in the "8 o'clock" position. The threads 18 have retained their previous position in FIGS. 11*a*, 11*b* in which they are located beneath the working plane 49, but the threads 19 have been moved through the working plane 49 into the interior of the circle 81, so that they are now located above the weft thread portion 38. FIG. 12*a* shows that in this working phase the curved connecting portion 20 is formed about the member 16.

In the third working position shown in FIGS. 13*a* and 13*b*, the upper passage 82', 83' has been formed for the travel of the filament 15 in the region of its "12 o'clock" position. The threads 18 are again located outside the circle 81. FIG. 13*a* shows that in this working phase the upper leg 27 is produced, as indicated at B in FIG. 6.

In the fourth working position or phase shown in FIGS. 14*a* and 14*b*, the filament 15 has traveled along the circle 81 in the direction 43 through approximately 60°, and has reached approximately the "2 o'clock" position, so that it is now located in the upper part of the shed, so that the next weft thread portion 39 can be inserted beneath it. The threads 18, 19 have been moved through the working plane 49 in mutually opposite directions, and with reference to the weft thread portion 39 they are located at opposite sides. In this phase of operation, a curved connecting portion 26 is being produced, as shown in FIG. 14*a*.

Before the complete weave is finished in the marginal portion of this zipper 10', the four operating positions area repeated insofar as the threads 18, 19 and the filament 15 are concerned. The next legs 27, 28 are produced, another curved connecting portion 26 is produced and a curved connecting portion 20 is produced, but with respect to the weft thread portion insertions 38', 39' which take place during this repetition of the four operating positions, the element 60 has been raised. For this purpose the element 60 is raised during the second through the fourth position of the second set of positions, by the pusher 62, so that it remains located during this time above the plane 49, which is not particularly illustrated. This means that when one operation is completed, the four operating states of FIGS. 11*a*–14*b* will have been completed two times in succession, and four weft thread portions 38, 39, 38', 39' will have been inserted before the operating cycle is repeated.

Figure 17:
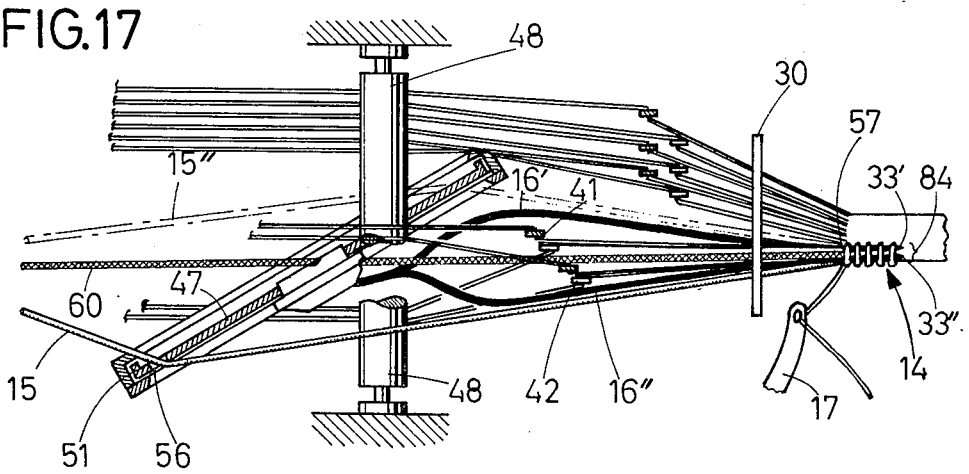
FIG. 17 is a view similar to FIG. 16, but illustrating a somewhat modified embodiment.

Coming now to FIG. 17, it will be seen that this Figure is analogous to FIG. 16, but illustrates a somewhat different embodiment of an apparatus. Insofar as like elements are concerned, like reference numerals have been used to designate them as in FIG. 16, and the same explanations will also obtain as were used in FIG. 16. The essential difference between FIGS. 16 and 17 resides in the fact that in FIG. 17 the member 16 has been subdivided into two branches 16′, 16″, which includes themselves the aforementioned triangular field in which the harnesses 41, 42 can move. The branches 16′, 16″ converge in the direction towards the beating-up point 57, but continue to have a minimum spacing 84 between their free end portions 33′, 33″, which corresponds to the desired breadth of the row 14. This produces a more exact shaping of the loops and positioning of the threads. The branches 16′, 16″ are located within the imaginary conical surface on which the filament 15 travels, as clearly indicated by the diametrically opposite locations of the filament 15 and its alternate position 15″ shown in broken lines.

Figure 18:
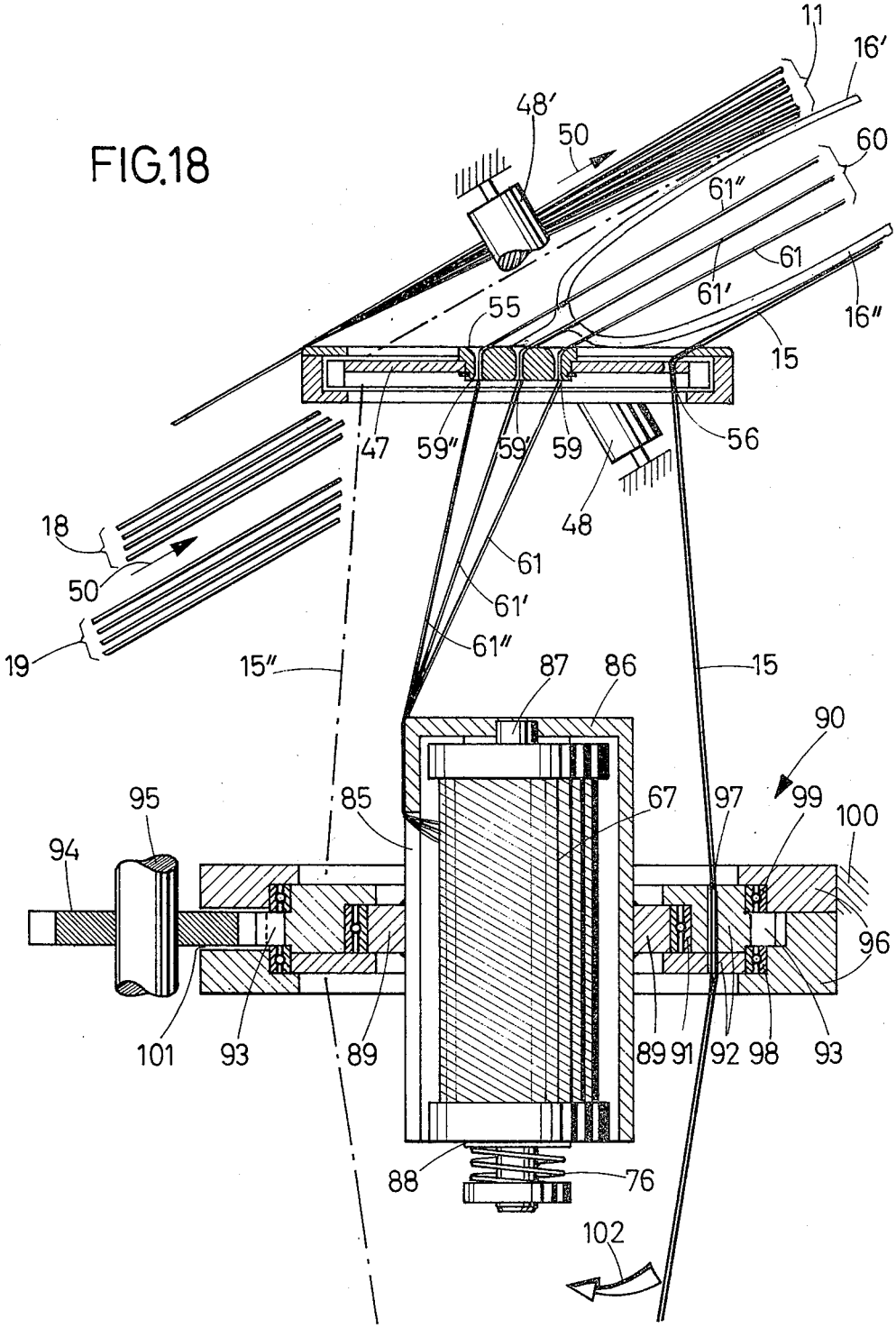
FIG. 18 is an enlarged partly sectioned top-plan view of a portion of a further embodiment of an apparatus for making the novel woven zipper.

Another embodiment of an apparatus for producing the zipper according to the present invention is shown in FIG. 18. In this Figure, the threads 11 which advance in the direction of the arrow 50, and the two groups of threads 18, 19 are somewhat diagrammatically indicated. However, the threads 18, 19 have not been illustrated in the region of the rollers 84, 84′ to avoid encumbering the drawing. The spool 67 for the element 60 is located behind the rotor 47 in a space which is located within the area surrounded by the imaginary conical surface described earlier, that is the imaginary conical surface on which the filament 15 travels. A turning device corresponding to the device 40 of FIG. 15 need not be provided in this embodiment. However, in the embodiment of FIG. 18 is has been illustrated that the element 16 is not a single unit, but is composed of a plurality of filamentary elements 61, 61′, 61″. These are convoluted laterally adjacent one another onto a common spool 67. Because of this particular possibility, a device 9 is required which is to prevent the individual filamentary elements 61–61″ from becoming twisted together when they are withdrawn from the spool 67. The device 9 assures that the position of the slot 85, which is provided in a stationary housing 86 and through which the filamentary elements 61–61″ are withdrawn, remains unchanged.

To make this possible, the spool 67 is mounted with its shaft 87 in the housing 86, and a braking spring 76 engages the shaft 86 at the free end thereof and exerts via a braking disc 88 a retarding effect upon the rotation of the spool 67. The housing 86 is formed with a fixedly connected flange 89 extending radially of it and provided at its circumference with a bearing 91 on which a ring 92 turns synchronously with the rotor 47 with as little friction as possible. The ring 92 is provided at its annular circumference with an annulus of gear teeth 93 and is driven from a gear 94 which is mounted on a drive shaft 95 and driven by a non-illustrated motor. The ring 92 is provided at its outer edge with a bore 97 extending parallel to its longitudinal axis and through which the filament 15 is passed which is withdrawn from a supply roller that is located behind the spool 67 but is not illustrated in the drawing.

In addition to the annulus of gear teeth 93, the ring 92 is provided with additional bearings 98, 99 which serves to assure as friction-free as possible a rotation of the ring 92 in a two-part housing 96. As indicated at 100, the housing 96 is mounted on a frame of the device (not illustrated in detail). It is formed on one portion of its circumference with a radial slot 101 through which the gear 94 extends into engagement with the annulus of gear teeth 93. This assures that the ring 92 will turn whereas the housing 96 is stationary, and while the housing 86 remains stationary also. As a result of this, the filament 15 will perform in the region of the spool 67 a movement in the direction of the arrow 102 about the stationary housing 86, so that the rear imaginary conical surface on which the filament 15 travels is elongated, because due to this synchronous movement the bore 97 and the ring 92 rotates in alignment with the opening 56 in the rotor 47, so that after half a rotation of the rotor, the filament 18 will move into the broken-line position 15′ even at the reverse side of the rotor 57.

The filamentary elements 61, 61′, 61″ pass, after they have traveled through the slot 85 of the housing 86, through appropriate bores 59, 59′, 59″ in the rotor insert 55, before they reach the front side of the rotor 47. The rotor insert 55 is stationary and can, if desired, be fixedly connected with the stationary housing 86. The filamentary elements 61–61″ travel in a horizontal plane laterally adjacent one another at predetermined spacing in the region of the member 16, which is here advantageously again branched to form the branches 16′, 16″, as in FIG. 17.

The further movement of the filamentary elements 61–61″ in the region where the weaving takes place is shown in FIGS. 19 and 20. In these Figures the same reference numerals are used as in FIGS. 15 and 16, and the zipper which is produced is identified with reference numeral 10″ as shown in FIG. 4.

FIG. 20 shows that in the space between the filamentary elements 61–61″, which space is indicated with reference numeral 103, there is located a respective cooperating pair of threads 18, 19. The element 61″ is located at the curved connecting portion 26′ (compare FIG. 4) and forwardly of the same there is no further upper thread 18 which could skid over this curved connecting portion 26. This assures that the connecting portions 26 are free to guide a slider. The elements 61–61″, the filament 15 and the threads 18, 19 are illustrated in FIGS. 19, 20 in a position corresponding to that which has been described in FIGS. 7*a*, 7*b* with respect to the embodiment to which those Figures are directed. The elements 61–61″ have been raised by respectively associated pushers 62 which engage them with their respective kerfs 63, as shown in FIG. 19, and have been raised through the working plane 49 of the needle 17 into the upper part of the shed. For this purpose the pushers 62 are mounted on a common mount 104 which can be raised in the direction of the arrow 63. In this operating phase a curved connecting portion 26 is being produced, as shown in FIG. 20. The needle 17 is about to move into the shed as indicated by the arrow 80 in FIG. 20, in order to insert a weft thread portion 34.

It should be noted that in FIGS. 19 and 20, the branches 16′, 16″, between which all of the elements 61–61″, the threads 18 and 19 are located, are located at opposite sides of the broken-line illustrated working plane 49. One branch 16′ always is located above the working plane 49, whereas the other branch 16″ is always located beneath this working plane. This results in a particularly exact binding of the various threads by the weft thread portions 34, 34′, and also produces a particularly exact width of the row 14 of loops, in keeping with the spacing 84 of the branches 16', 16'' from one another.

Figure 4:
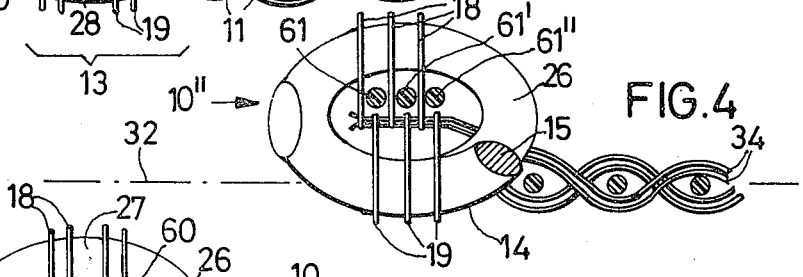
FIG. 4 is a view similar to FIG. 3, but illustrating a somewhat different embodiment of the invention.

FIGS. 1, 7*a*–10*a* and 20 indicate clearly that the row 14 of loops which, as shown in FIGS. 2 and 3, extends to one side of the plane of the zipper tape or, as shown in FIG. 4, extends to the other side thereof, is overlapped by the respective connecting loop portions 105 between consecutive weft thread portions 34, 34' adjacent to the respective connecting portions 20. In the region of the connecting portions 26, the weft thread portions 34, 34' pass beneath the filament 15. The loop portions 105 thus serve to further increase the stability of connection of the row 14 to the tape. This is also true for the zipper 10' of FIGS. 11*a*–14*b*.

The present invention makes it possible to produce a woven zipper which is very simple, requires a minimum of wefts and filaments, has great strength and does not admit of relative displacement between successive ones of its loop portions in the row 14.

It will be understood that each of the elements described above, or two or more together, may also find a useful application in other types of construction differing from the type described above.

While the invention has been illustrated and described as embodied in a method and apparatus for making a woven zipper, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and described to be protected by Letters Patent is set forth in the appended claims.

1. Apparatus for making a woven zipper, comprising first means for forming a warp shed; second means for inserting a weft thread into said warp shed so as to weave a zipper tape; third means for laying onto a longitudinal margin of said zipper tape a plurality of coils formed from a continuous filament; fourth means for weaving said coils to said tape by means of cover threads which are interwoven with said coils and said tape; a rotor having a side facing towards said third means; harneses which are longitudinally shiftable between end positions and are located at said side and have end portions provided with openings through which respective ones of said cover threads extend, means for shifting said harnesses so that said openings travel in a triangular area determined by the points of intersection of a plane of movement of said second means with said openings when said harnesses are in the respective end positions, and the point where said filament first contacts said margin when laid upon the same by said third means; and said third means comprising a bifurcated member having two branches which between themselves include said triangular area, said branches having free end portions which converge towards said point where said filament first contacts said margin and forming there with one another a gap.

2. Apparatus as defined in claim 1, wherein said branches are located at opposite sides of said plane.

3. Apparatus for making a woven zipper, comprising first means for forming a warp shed; second means for inserting a weft thread into said warp shed so as to weave a zipper tape; third means for laying onto a longitudinal margin of said zipper tape a plurality of coils formed from a continuous filament; fourth means for weaving said coils to said tape by means of cover threads which are interwoven with said coils and said tape; a rotor having a side facing towards said third means; and harnesses which are longitudinally shiftable between end positions and are located at said side and have end portions provided with openings through which respective ones of said cover threads extend; means for shifting said harnesses so that said openings travel in a triangular area determined by the points of intersection of a plane of movement of said second means with said openings when said harnesses are in the respective end positions, and the point where said filament first contacts said margin when laid upon the same by said third means, said rotor having a stationary center portion and an outer rotary portion, said center portion having a plurality of laterally spaced parallel bores each adapted for travel therethrough of an elongated flexible supporting element which is to be deposited on said margin, each opening being aligned with a gap between the paths of movement of said harnesses.

4. Apparatus for making a woven zipper, comprising first means for forming a warp shed; second means for inserting a weft thread into said warp shed so as to weave a zipper tape; third means for laying onto a longitudinal margin of said zipper tape a plurality of coils formed from a continuous filament; and fourth means for weaving said coils to said tape by means of cover threads which are interwoven with said coils and said tape; a rotor having a side facing towards said third means; harnesses which are longitudinally shiftable between end positions and are located at said side and have end portions provided with openings through which respective ones of said cover threads extend; means for shifting said harnesses so that said openings travel in a triangular area determined by the points of intersection of a plane of movement of said second means with said openings when said harnesses are in the respective end positions, and the point where said filament first contacts said margin when laid upon the same by said third means, said rotor having a stationary center portion provided with a bore through which an elongated flexible supporting element travels which is to be deposited on said margin and said rotor further having a rotary outer portion formed with an opening through which said filament travels axially; and a supply spool for said supporting element, said supply spool being located axially adjacent said rotor in an area about which said filament travels when said outer portion rotates and while said filament travels axially through said opening.

5. Apparatus as defined in claim 4; further comprising a ring rotatably surrounding said supply spool and supporting the same, said ring element having a bore through which said filament travels; and means connecting said ring with said outer portion of said rotor for joint rotation therewith.

6. Apparatus for making a woven zipper, comprising first means for forming a warp shed; second means movable in a plane for inserting a weft thread into said warp shed so as to weave a zipper tape; third means for moving portions of a continuous filament along a circular path and for forming from said filament a plurality of coils which are laid onto a longitudinal margin of said zipper tape; and fourth means movable through the space surrounded by said circular path for weaving said coils to said tape by advancing cover threads through said space and said plane so that said cover threads are interwoven with said coils and said tape.

* * * * *